US009960493B2

(12) United States Patent
Luk et al.

(10) Patent No.: US 9,960,493 B2
(45) Date of Patent: May 1, 2018

(54) PATCH ANTENNA

(71) Applicant: City University of Hong Kong, Kowloon (HK)

(72) Inventors: Kwai-Man Luk, Kowloon (HK); Yujian Li, Kowloon (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 0 days. days.

(21) Appl. No.: 14/808,117

(22) Filed: Jul. 24, 2015

(65) Prior Publication Data

US 2017/0025760 A1 Jan. 26, 2017

(51) Int. Cl.
*H01Q 9/04* (2006.01)

(52) U.S. Cl.
CPC ..... *H01Q 9/0457* (2013.01)

(58) Field of Classification Search
CPC ..... H01Q 9/0407; H01Q 1/22; H01Q 1/38; H01Q 9/0457
USPC ..... 343/720
See application file for complete search history.

(56) References Cited

U.S. PATENT DOCUMENTS 5,844,523 A * 12/1998 Brennan ..... H01Q 1/22 174/138 A
6,208,903 B1 * 3/2001 Richards ..... A61N 5/04 607/101
6,400,324 B1 * 6/2002 Macias ..... H01Q 1/125 343/702
6,927,745 B2 * 8/2005 Brown ..... H01Q 1/281 343/909
6,992,628 B2 * 1/2006 Rawnick ..... H01Q 9/0407 343/700 MS
7,283,095 B2 * 10/2007 Karanik ..... H01Q 9/0407 343/700 MS
7,425,922 B1 * 9/2008 Adams ..... H01Q 9/0428 343/700 MS
8,487,822 B1 * 7/2013 Jennings ..... H01Q 9/14 343/745
2005/0030133 A1 * 2/2005 Rawnick ..... H01P 7/06 333/231
2006/0256027 A1 * 11/2006 Rawnick ..... H01Q 9/0457 343/861
2011/0260936 A1 * 10/2011 Leung ..... F24J 2/12 343/720
2012/0075069 A1 * 3/2012 Dickey ..... H01Q 1/364 340/10.1
2012/0280870 A1 * 11/2012 Maxwell ..... H01Q 1/38 343/745

(Continued)

OTHER PUBLICATIONS

Kosta, Y., Liquid Antenna Systems, 2004, IEEE, pp. 1-4.*

(Continued)

*Primary Examiner* — Dameon E Levi
*Assistant Examiner* — David Lotter
(74) *Attorney, Agent, or Firm* — Amin, Turocy & Watson, LLP

(57) ABSTRACT

A patch antenna is presented herein. The patch antenna can include a substrate layer, a dielectric layer and a conductive layer. The substrate layer can include a hollow thermoplastic structure. The dielectric layer can be attached to a surface of the substrate layer. Furthermore, the dielectric layer can include a thermoplastic structure filled with a fluid. The conductive layer can be associated with another surface of the substrate layer.

20 Claims, 15 Drawing Sheets

(56) References Cited

U.S. PATENT DOCUMENTS

| | | | | |
|---|---|---|---|---|
| 2013/0021217 | A1* | 1/2013 | Tsai | H01Q 9/28 343/807 |
| 2013/0335275 | A1* | 12/2013 | Sanford | H01Q 1/243 343/702 |
| 2015/0207215 | A1* | 7/2015 | Dickey | H01Q 1/364 29/600 |

OTHER PUBLICATIONS

Paixao et al., Patch Antenna with T-Shaped Probe Feed for Broadband Applications, 2009, IEEE, pp. 218-220.*

Paraschakis, et al., "Ionic liquid antenna," in IEEE Int. Workshop on Antenna Tech.: Small Antennas and Novel Metamaterials, pp. 552-554, 2005.

Fayad, et al., "Broadband liquid antenna," Electron. Lett., vol. 42, No. 3, pp. 133-134, 2006.

O'Keefe, et al., "Tunability of liquid dielectric resonator antennas,"IEEE Antennas Wireless Propag. Lett., vol. 6, pp. 533-536, 2007.

Zhou, et al., "A compact water based dielectric resonator antenna," in IEEE AP-S Int. Symp., pp. 1-4, Jun. 2009.

Zhou, et al., "Liquid-based dielectric resonator antenna and its application for measuring liquid real permittivities," IET Microw., Antennas Propag., vol. 8, No. 4, pp. 255-262, Aug. 2014.

Clasen, et al., "Meshed patch antennas," IEEE Trans Antennas Propag., vol. 52, No. 6, pp. 1412-1416, Jun. 2004.

* cited by examiner

1500

PATCH ANTENNA

TECHNICAL FIELD

The subject disclosure generally relates to embodiments for a patch antenna.

BACKGROUND

Recently, water monopole antennas and water dielectric resonator antennas have been employed for certain antenna applications (e.g., wideband antenna applications, reconfigurable antenna applications, frequency tuning applications, etc.). However, such antenna technologies have had some drawbacks, some of which may be noted with reference to the various embodiments described herein below.

SUMMARY

A simplified summary is provided herein to help enable a basic or general understanding of various aspects of exemplary, non-limiting embodiments that follow in the more detailed description and the accompanying drawings. This summary is not intended, however, as an extensive or exhaustive overview. Instead, the purpose of this summary is to present some concepts related to some exemplary non-limiting embodiments in simplified form as a prelude to more detailed description of the various embodiments that follow in the disclosure.

According to one example embodiment, described herein is a patch antenna that includes a substrate layer, a dielectric layer and a conductive layer. The substrate layer includes a hollow thermoplastic structure. The dielectric layer is attached to a surface of the substrate layer. Furthermore, the dielectric layer includes a thermoplastic structure filled with a fluid. The conductive layer is associated with another surface of the substrate layer.

According to another example embodiment, described herein is a device that includes an antenna and a set of solar cells. The antenna includes a fluid layer, a metallic layer attached to a feeding probe, and a substrate layer between the fluid layer and the metallic layer. The set of solar cells is attached to the metallic layer and the substrate layer.

According to yet another example embodiment, described herein is an antenna system that includes a first thermoplastic, a second thermoplastic structure, and a conductive ground plane. The first thermoplastic structure comprises a fluid. The second thermoplastic structure is hollow and supports the first thermoplastic structure via a first surface. The conductive ground plane is attached to a second surface of the second thermoplastic structure.

These and other embodiments or implementations are described in more detail below with reference to the drawings.

BRIEF DESCRIPTION OF THE DRAWINGS

Non-limiting embodiments of the subject disclosure are described with reference to the following figures, wherein like reference numerals refer to like parts throughout the various views unless otherwise specified.

DETAILED DESCRIPTION

Figure 1:
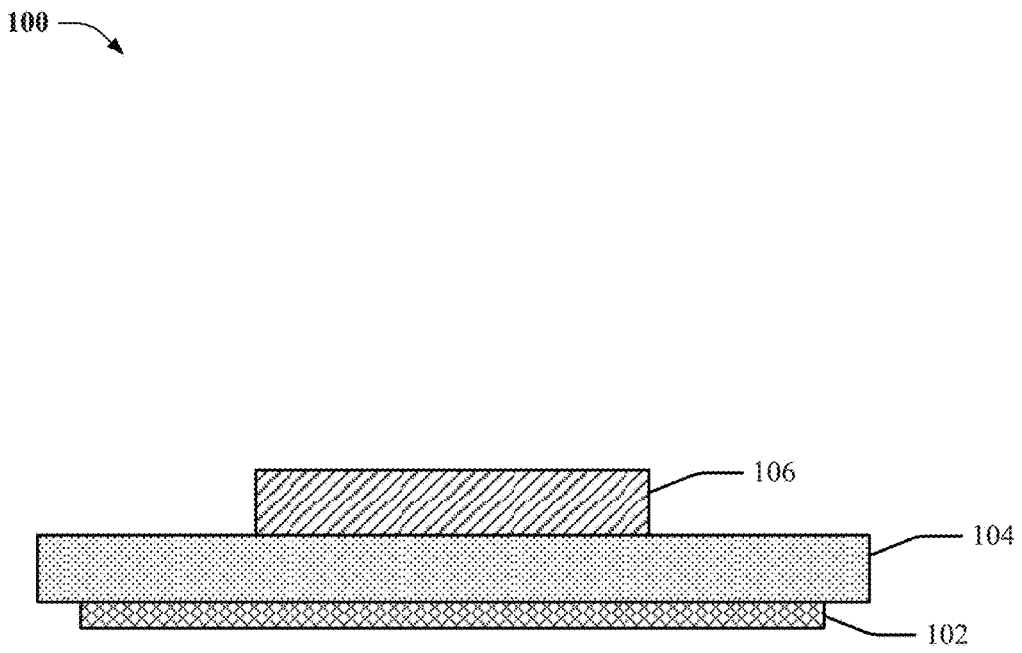
FIG. 1 illustrates a side view of an exemplary antenna, in accordance with various embodiments.

Aspects of the subject disclosure will now be described more fully hereinafter with reference to the accompanying drawings in which example embodiments are shown. In the following description, for purposes of explanation, numerous specific details are set forth in order to provide a thorough understanding of the various embodiments. However, the subject disclosure may be embodied in many different forms and should not be construed as limited to the example embodiments set forth herein.

Recently, water monopole antennas and water dielectric resonator antennas have been employed for certain antenna applications (e.g., wideband antenna applications, reconfigurable antenna applications, frequency tuning applications, etc.). However, water monopole antennas and water dielectric resonator antennas have some drawbacks. To these and/or related ends, various embodiments disclosed herein provide for an improved patch antenna that can be employed in, for example, wireless communication applications. In an aspect, a patch antenna can comprise a fluid patch mounted above a conductive ground plane (e.g., a metallic ground plane). The fluid patch can comprise a fluid, such as but not limited to, water, methanol, alcohol, glycerin, another fluid, etc. The patch antenna (e.g., a cavity mode of the patch antenna) can be excited by a feeding probe (e.g., an L-shaped probe, a T-shaped probe, etc.) attached to the conductive ground plane. Alternatively, the patch antenna (e.g., the cavity mode of the patch antenna) can be excited by another feeding technique.

In another aspect, the patch antenna can comprise a supporting substrate between the fluid patch and the conductive ground plane. The supporting substrate can be, for example, a supporting substrate that comprises a hollow cavity. Relative permittivity of the fluid included in the fluid patch can be greater than relative permittivity of the supporting substrate. As such, an electromagnetic wave reflection can be present at an interface between the fluid patch and the supporting substrate. Moreover, the interface between the fluid patch and the supporting substrate can be behave as an electric wall. In yet another aspect, the patch antenna can be transparent. In certain implementations, the patch antenna can be integrated with a set of solar cells (e.g., to form a dual-function device). An operation mechanism of the patch antenna can be different than conventional antennas (e.g., conventional water monopole antennas, conventional water dielectric resonator antennas, etc.). Moreover, the patch antenna can comprise a lower profile, improved radiation characteristics (e.g., higher radiation efficiency), a wider impedance bandwidth (e.g., a wide operating bandwidth greater than 20%), and/or improved transparency as compared to conventional antennas (e.g., without working as a conductor for current flow or a dielectric resonator).

In an embodiment, a patch antenna comprises a substrate layer, a dielectric layer and a conductive layer. The substrate layer can comprise a hollow thermoplastic structure. The dielectric layer can be attached to a surface of the substrate layer. Furthermore, the dielectric layer can comprise a thermoplastic structure filled with a fluid. The conductive layer can be associated with another surface of the substrate layer.

In another embodiment, a device comprises an antenna and a set of solar cells. The antenna can comprise a fluid layer, a metallic layer attached to a feeding probe, and a substrate layer between the fluid layer and the metallic layer. The set of solar cells can be attached to the metallic layer and the substrate layer.

In yet another embodiment, an antenna system comprises a first thermoplastic, a second thermoplastic structure, and a conductive ground plane. The first thermoplastic structure can comprise a fluid. The second thermoplastic structure can be hollow and can support the first thermoplastic structure via a first surface. The conductive ground plane can be attached to a second surface of the second thermoplastic structure.

Reference throughout this specification to "one embodiment," or "an embodiment," means that a particular feature, structure, or characteristic described in connection with the embodiment is included in at least one embodiment. Thus, the appearances of the phrase "in one embodiment," or "in an embodiment," in various places throughout this specification are not necessarily all referring to the same embodiment. Furthermore, the particular features, structures, or characteristics may be combined in any suitable manner in one or more embodiments.

To the extent that the terms "includes," "has," "contains," and other similar words are used in either the detailed description or the appended claims, such terms are intended to be inclusive—in a manner similar to the term "comprising" as an open transition word—without precluding any additional or other elements. Moreover, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Further, the word "exemplary" and/or "demonstrative" is used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art having the benefit of the instant disclosure.

Conventional antenna technologies have some drawbacks with respect to certain antenna applications (e.g., patch antenna applications, etc.) and/or certain antenna characteristics. On the other hand, various embodiments disclosed herein provide for an improved antenna (e.g., an improved patch antenna) that can be employed in, for example, wireless communication applications. In this regard, and now referring to FIG. 1, a side view of an antenna 100 is illustrated, in accordance with various embodiments. The antenna 100 can be, for example, a patch antenna, a fluid patch antenna (e.g., a water patch antenna, etc.), another type of antenna, etc. In one example, the antenna 100 can be employed in a wireless communication system (e.g., to transmit and/or receive radio signals, etc.).

The antenna 100 includes a conductive layer 102, a substrate layer 104 and a dielectric layer 106. The dielectric layer 106 can be attached to a surface of the substrate layer 104. The substrate layer 104 can be associated with a larger surface area than the dielectric layer 106. For example, the dielectric layer 106 can cover a portion of the surface of the substrate layer 104, while another portion of the surface of the substrate layer 104 is uncovered. Furthermore, the conductive layer 102 can be associated with another surface of the substrate layer 104. The conductive layer 102 can cover an entire portion of the other surface of the substrate layer 104 (e.g., an entire surface of the substrate layer 104 that is not attached to the dielectric layer 104). Alternatively, the conductive layer 102 can cover a portion of the other surface of the substrate layer 104 (e.g., a portion of the surface of the substrate layer 104 that is not attached to the dielectric layer 104).

The conductive layer 102 can be a conductive ground plane. In one example, the conductive layer 102 can be a metallic layer (e.g., the conductive layer 102 can be a metallic ground plane). The substrate layer 104 can comprise a hollow thermoplastic structure. For example, the hollow thermoplastic structure of the substrate layer 104 can be a thermoplastic structure that includes a hollow cavity (e.g., the hollow thermoplastic structure can be a thermoplastic boxed structure that includes a cavity filled with air). The dielectric layer 106 can be a fluid layer (e.g., a fluid patch). The dielectric layer 106 can comprise a thermoplastic structure filled with a fluid (e.g., a liquid). For example, the thermoplastic structure of the dielectric layer 106 can be a thermoplastic structure that includes a cavity filled with a fluid (e.g., the thermoplastic structure of the dielectric layer 106 can be a thermoplastic boxed structure that includes a cavity filled with a fluid). The fluid (e.g., the liquid) can be associated with a high relative permittivity (e.g., a relative permittivity greater that 20, etc.). For example, the dielectric layer 106 can comprise a thermoplastic structure filled with water, methanol, alcohol, glycerin or another fluid. The hollow thermoplastic structure of the substrate layer 104 can be a supporting structure for the thermoplastic structure of the dielectric layer 106. In one example, the thermoplastic structure of the substrate layer 104 and the thermoplastic structure of the dielectric layer 106 can be a transparent thermoplastic structure. The substrate layer 104 can comprise a different shape than the dielectric layer 106. For example, the substrate layer 104 can be associated with a first shape and the dielectric layer 106 can be associated with a second shape (e.g., the substrate layer 104 can be square-shaped and the dielectric layer 106 can be a different shape, the substrate layer 104 can be rectangular-shaped and the dielectric layer 106 can be a different shape, etc.). In another example, a shape of the substrate layer 104 can correspond to a shape of the dielectric layer 106.

The conductive layer 102 can facilitate excitation of the antenna 100. In an aspect, the conductive layer 102 can be excited by a feeding probe mounted to the conductive layer 102. Furthermore, a communication connector can be mounted to the feeding probe and/or the conductive layer 102. In another aspect, the conductive layer 102 can include a coupling aperture. In yet another aspect, the conductive layer 102 can be excited by another substrate layer that comprises a transmission line (e.g., a microstrip transmission line). In yet another aspect, the conductive layer 102 can be excited by a probe inserted into the dielectric layer 106. In certain implementation, the antenna 100 can be associated with a dual-function device. For example, the conductive layer 102 and/or the substrate layer 104 can be mounted to a set of solar cells (e.g., an array of solar cells).

Figure 2:
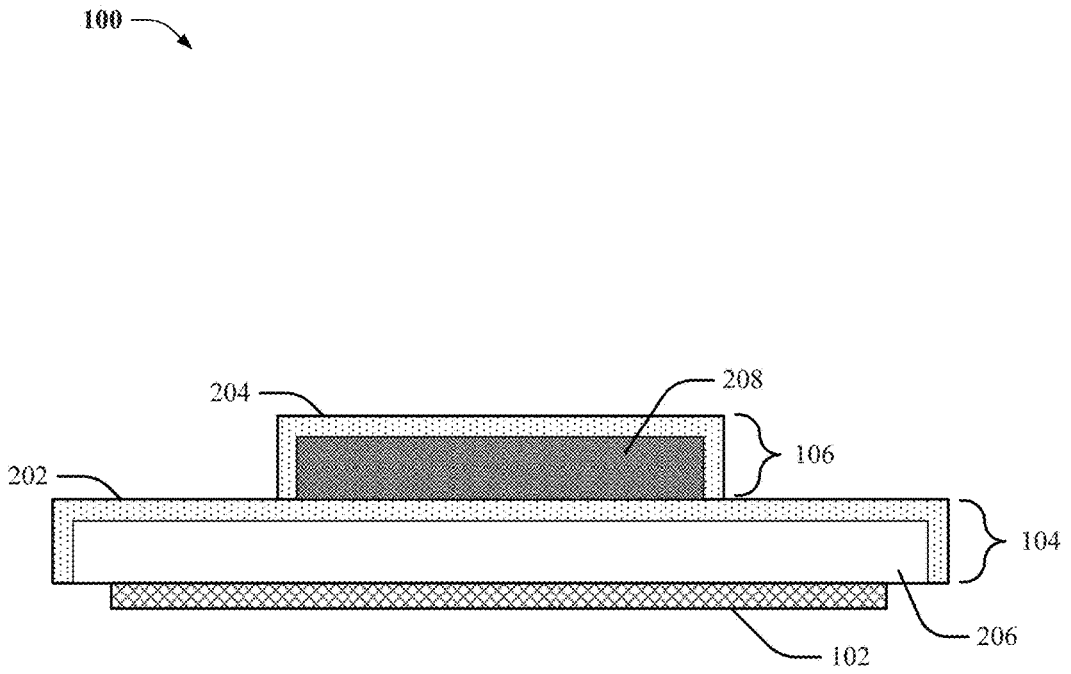
FIG. 2 illustrates an alternative side view of the exemplary antenna, in accordance with various embodiments.

Referring to FIG. 2, another side view of the antenna 100 is illustrated, in accordance with various embodiments. As shown in FIG. 2, the substrate layer 104 includes a thermoplastic structure 202 and the dielectric layer 106 includes a thermoplastic structure 204. The thermoplastic structure 202 can be a hollow thermoplastic structure. For example, the thermoplastic structure 202 can be a partially hollow thermoplastic structure that includes a cavity 206 filled with air. Furthermore, the thermoplastic structure 204 can include a cavity 208 filled with a fluid. For example, the cavity 208 can be filled with water, methanol, alcohol, glycerin or another fluid. As such, the antenna 100 can include a first thermoplastic structure (e.g., the thermoplastic structure 204) that comprises a fluid, a second thermoplastic structure (e.g., the thermoplastic structure 202) that is hollow and supports the first thermoplastic structure via a first surface, and a conductive ground plane (e.g., the conductive layer 102) that is attached to a second surface of the second thermoplastic structure. In one example, the thermoplastic structure 204 can be implemented as a fluid patch. The thermoplastic structure 204 can be smaller than the thermoplastic structure 202 (e.g., the hollow thermoplastic structure). For example, a portion of a surface of the thermoplastic structure 202 can be attached to the thermoplastic structure 204. In an aspect, the thermoplastic structure 202 and the thermoplastic structure 204 can be transparent (e.g., a transparent thermoplastic structure).

In an implementation, the thermoplastic structure 202 can comprise a different shape than the thermoplastic structure 204. For example, the thermoplastic structure 202 can be a square-shaped structure and the thermoplastic structure 204 can be a rectangular-shaped structure, a circular-shaped structure or a triangular-shaped structure. In another example, the thermoplastic structure 202 can be a rectangular-shaped structure and the thermoplastic structure 204 can be a square-shaped structure, a circular-shaped structure or a triangular-shaped structure. In yet another example, the thermoplastic structure 202 can be a circular-shaped structure and the thermoplastic structure 204 can be a square-shaped structure, a rectangular-shaped structure or a triangular-shaped structure. In yet another example, the thermoplastic structure 202 can be a triangular-shaped structure and the thermoplastic structure 204 can be a square-shaped structure, a circular-shaped structure or a rectangular-shaped structure. In another implementation, the thermoplastic structure 202 can comprise the same shape as the thermoplastic structure 204. For example, the thermoplastic structure 202 and the thermoplastic structure 204 can be a square-shaped structure, the thermoplastic structure 202 and the thermoplastic structure 204 can be a rectangular-shaped structure, the thermoplastic structure 202 and the thermoplastic structure 204 can be a circular-shaped structure, the thermoplastic structure 202 and the thermoplastic structure 204 can be a triangular-shaped structure, etc. However, it is to be appreciated that the thermoplastic structure 202 and/or the thermoplastic structure 204 can comprise a different shape.

Figure 3:
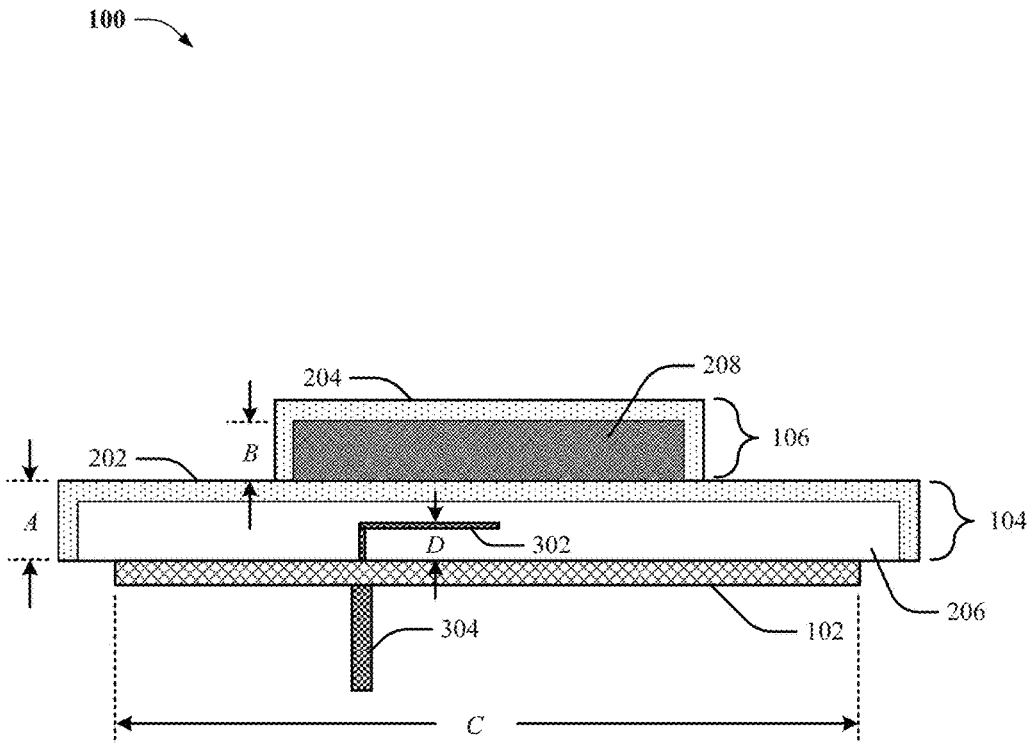
FIG. 3 illustrates a side view of the exemplary antenna that comprises an exemplary feeding probe and an exemplary communication connector, in accordance with various embodiments.

Referring to FIG. 3, yet another side view of the antenna 100 is illustrated, in accordance with various embodiments. As shown in FIG. 3, in certain implementations, the antenna 100 also includes a feeding probe 302 and/or a communication connector 304. The feeding probe 302 can be mounted to the conductive layer 102. In an aspect, the conductive layer 102 can be excited by the feeding probe 302. The communication connector 304 can be mounted to the feeding probe 302 and/or the conductive layer 102. The communication connector 304 can be, for example, a coaxial connector (e.g., a SubMiniature version A (SMA) connector, etc.). In one example, the feeding probe can be an L-shaped feeding probe. In another example, the feeding probe can be a T-shaped feeding probe. In yet another example, the feeding probe can be a meander-shaped feeding probe. In yet another example, the feeding probe can be a probe with a top-loaded patch. However, it is to be appreciated that the feeding probe 302 can be a different shape and/or a different type of probe.

Figure 4:
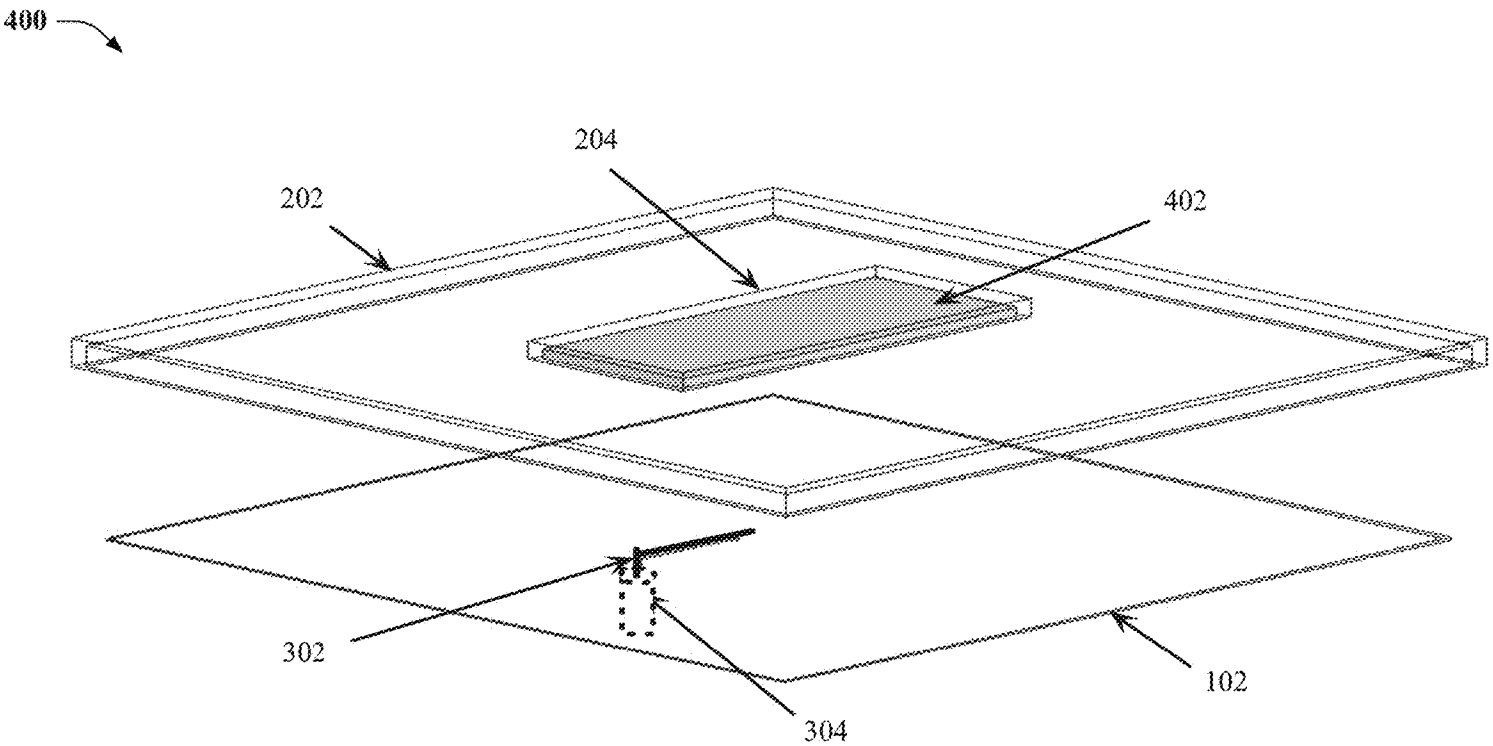
FIG. 4 illustrates a perspective view of the exemplary antenna, in accordance with various embodiments.

Referring now to FIG. 4, a perspective view 400 of different layers of the antenna 100 is illustrated, in accordance with various embodiments. For example, as shown in FIG. 4, the thermoplastic structure 204 can be mounted to the thermoplastic structure 202 (e.g., the thermoplastic structure 202 and the thermoplastic structure 204 can be stacked together). Furthermore, the thermoplastic structure 204 can be filled with a fluid 402. The fluid 402 can be water, methanol, alcohol, glycerin or another fluid. The fluid 402 can fill a cavity (e.g., the cavity 208) of the thermoplastic structure 204. Additionally, a surface of the conductive layer 102 can be attached to the feeding probe 302 and another surface of the conductive layer 102 can be attached to the communication connector 304 (e.g., the feeding probe 302 can also be connected to the communication connector 304). In an implementation, the thermoplastic structure 202 can be a first boxed structure made of thermoplastic (e.g., a first thermoplastic box) and the thermoplastic structure 204 can be a second boxed structure made of thermoplastic (e.g., a second thermoplastic box). In a non-limiting example, thermoplastic of the thermoplastic structure 202 and the thermoplastic structure 204 can comprise a thickness of 4 mm and/or a dielectric constant of 3.4. For example, a thermoplastic wall surrounding the cavity 206 and/or the cavity 208 can comprise a thickness of 4 mm and/or a dielectric constant of 3.4. However, it is to be appreciated that the thermoplastic of the thermoplastic structure 202 and the thermoplastic structure 204 can comprise a different thickness and/or a different dielectric constant. In another non-limiting example, the thermoplastic structure 204 can be filled with pure water (e.g., the fluid 402) to construct a water patch (e.g., a water dielectric patch). The thermoplastic structure 202 can be empty and can also be employed as a supporting structure (e.g., air can be a supporting substrate for the water patch). The conductive layer 102 can be attached to a surface of the thermoplastic structure 202 to form the antenna 100. For example, the conductive layer 102 (e.g., a square metallic ground plane) can be installed at a bottom surface of the thermoplastic structure 202. The feeding probe 302 (e.g., an L-shaped feeding probe, a T-shaped feeding probe, etc.) can be mounted to the thermoplastic structure 202. Furthermore, the communication connector 304 (e.g., an SMA connector) can be connected to the feeding probe 302 (e.g., to obtain one or more measurements associated with the antenna 100). Compared to conventional water antennas (e.g., conventional water monopoles, conventional water dielectric resonator antennas, etc.), the antenna 100 can comprise a higher radiation efficiency (e.g., since the antenna 100 can be realized via a patch mode and/or since only a portion of energy penetrates into the fluid 402).

Figure 5:
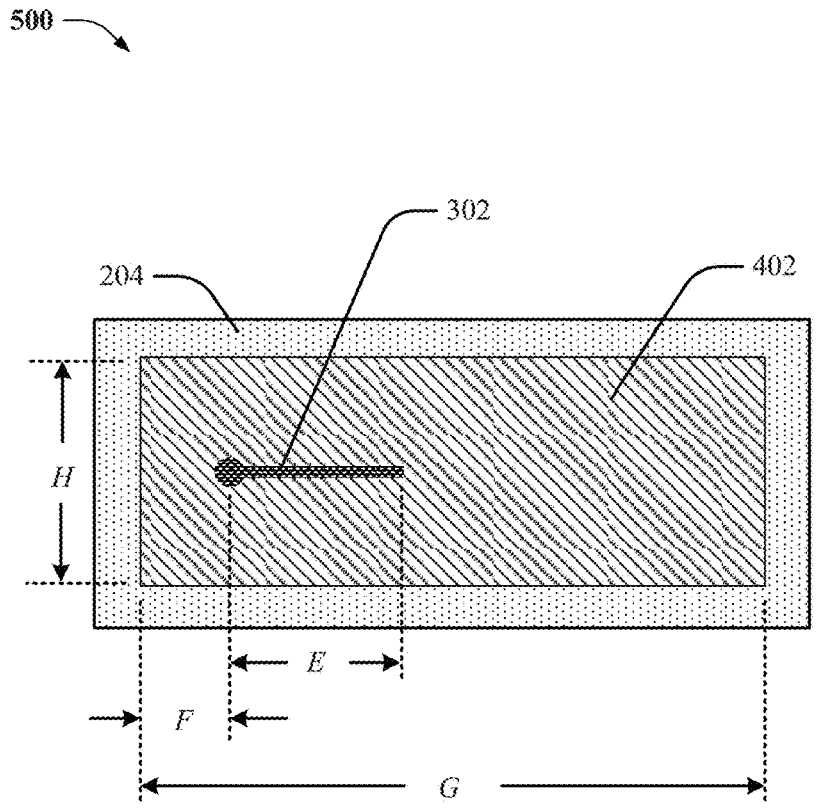
FIG. 5 illustrates a top view of a thermoplastic structure, in accordance with various embodiments.

Referring to FIG. 5, a top view 500 of the thermoplastic structure 204 is illustrated, in accordance with various embodiments. A cavity of the thermoplastic structure 204 can be filled with the fluid 402. Furthermore, the feeding probe 302 can be aligned underneath the thermoplastic structure 204 (e.g., underneath the fluid 402 filled in the cavity of the thermoplastic structure 204). The feeding probe 302 can be oriented, for example, with respect to a longer side of the thermoplastic structure 204. Furthermore, the feeding probe 302 can be oriented, for example, in a first half of the thermoplastic structure 204 (e.g., a first half of the thermoplastic structure 204 can be associated with the feeding probe 302, while a second half of the thermoplastic structure 204 is not associated with the feeding probe 302). However, it is to be appreciated that the feeding probe 302 can be arranged in a different orientation with respect to the thermoplastic structure 204. In the embodiment of the thermoplastic structure 204 shown in FIG. 5, the thermoplastic structure 204 can be rectangular-shaped. However, it is to be appreciated that the thermoplastic structure 204 can be a different shape.

Values of parameters A-D shown in FIG. 3 and parameters E-H shown in FIG. 5 for an example patch antenna design are listed in Table I shown below. In a non-limiting example, the example patch antenna design associated with Table I can be realized at a 900-MHz frequency band. Furthermore, the example patch antenna design associated with Table I can comprise a resonant frequency f0 equal to 0.93 GHz, a beamwidth (where a reflection coefficient |S11|<−10 dB) equal to 7.5%, and a maximum gain equal to 7.4 dBi.

TABLE I

| Parameter | A | B | C | D |
|---|---|---|---|---|
| Value | 10.0 mm | 5.0 mm | 350.0 mm | 5.9 mm |
| Parameter | E | F | G | H |
| Value | 57.0 mm | 15.0 mm | 190.0 mm | 80.0 mm |

Values of parameters A-D shown in FIG. 3 and parameters E-H shown in FIG. 5 for another example patch antenna design are listed in Table II shown below. In a non-limiting example, the other example patch antenna design associated with Table II can be realized at a 900-MHz frequency band. Furthermore, the other example patch antenna design associated with Table II can comprise a resonant frequency $f_0$ equal to 0.92 GHz, a beamwidth (where a reflection coefficient |S11|<−10 dB) equal to 10.7%, and a maximum gain equal to 8.3 dBi.

TABLE II

| Parameter | A | B | C | D |
|---|---|---|---|---|
| Value | 20.0 mm | 5.0 mm | 350.0 mm | 15.9 mm |
| Parameter | E | F | G | H |
| Value | 52.0 mm | 35.0 mm | 160.0 mm | 80.0 mm |

Values of parameters A-D shown in FIG. 3 and parameters E-H shown in FIG. 5 for yet another example patch antenna design are listed in Table III shown below. In a non-limiting example, the other example patch antenna design associated with Table III can be realized at a 900-MHz frequency band. Furthermore, the other example patch antenna design associated with Table III can comprise a resonant frequency $f_0$ equal to 0.90 GHz, a beamwidth (where a reflection coefficient |S11|<−10 dB) equal to 22.6%, and a maximum gain equal to 8.0 dBi.

TABLE III

| Parameter | A | B | C | D |
|---|---|---|---|---|
| Value | 30.0 mm | 5.0 mm | 350.0 mm | 25.9 mm |
| Parameter | E | F | G | H |
| Value | 33.0 mm | 433.0 mm | 130.0 mm | 80.0 mm |

It is to be appreciated that values of parameters A-H shown in Table I, Table II and Table III are merely examples. As such, parameters A-H shown in FIG. 3 and FIG. 5 can comprise different values.

Figure 6A:
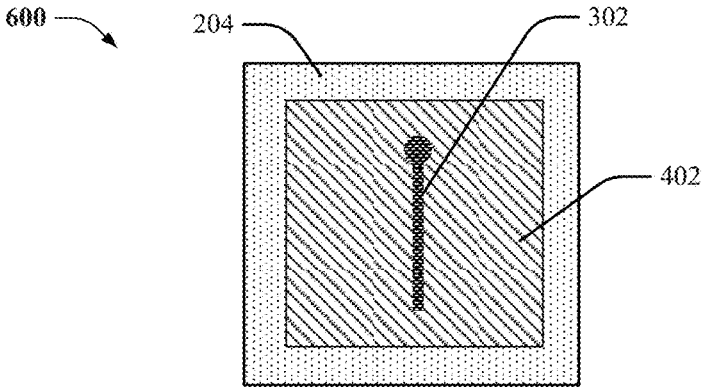
FIGS. 6A-C illustrate various shapes for a thermoplastic structure, in accordance with various embodiments.
Figure 6B:
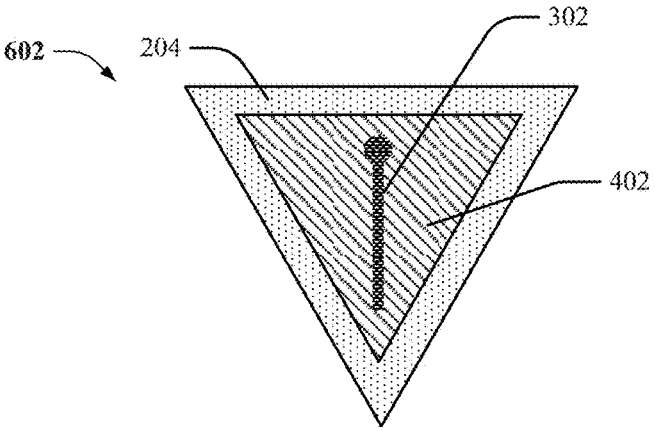
Figure 6C:
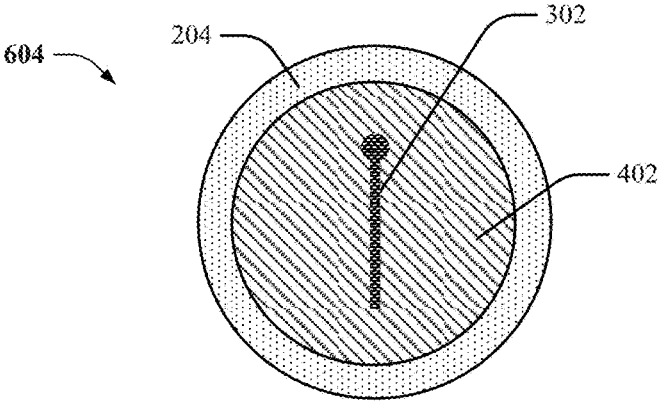
Figure 7:
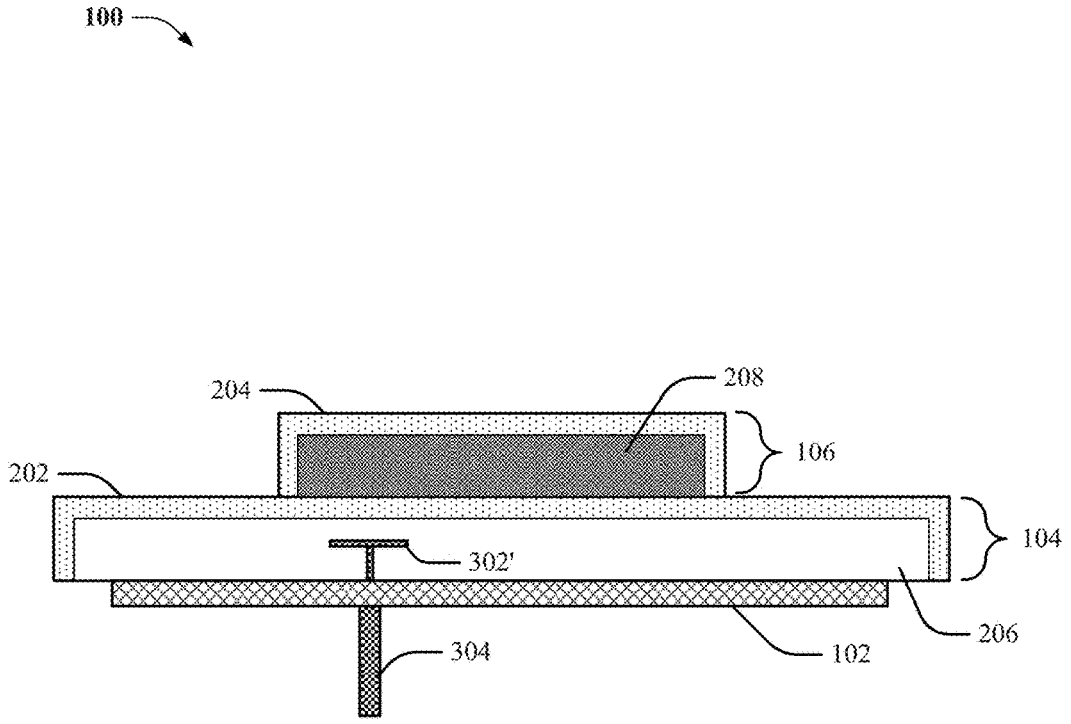
FIG. 7 illustrates a side view of the exemplary antenna that comprises another exemplary feeding probe, in accordance with various embodiments.

FIGS. 6A-C illustrate various shapes for the thermoplastic structure 204, in accordance with various embodiments. For example, FIG. 6A illustrates a top view 600 of the thermoplastic structure 204 where the thermoplastic structure 204 is square-shaped (e.g., where the thermoplastic structure 204 is a square-shaped thermoplastic box with a cavity), FIG. 6B illustrates a top view 602 of the thermoplastic structure 204 where the thermoplastic structure 204 is triangular-shaped (e.g., where the thermoplastic structure 204 is a triangular-shaped thermoplastic box with a cavity), and FIG. 6C illustrates a top view 604 of the thermoplastic structure 204 where the thermoplastic structure 204 is circular-shaped (e.g., where the thermoplastic structure 204 is a circular-shaped thermoplastic box with a cavity). However, it is to be appreciated that the thermoplastic structure 204 can comprises a different shape. As shown in FIGS. 6A-C, the feeding probe 302 can be aligned underneath the thermoplastic structure 204 (e.g., underneath the fluid 402 filled in the cavity of the thermoplastic structure 204).

FIGS. 7-10 illustrate alternate embodiments of the feeding probe 302 included in the antenna 100, in accordance with various embodiments. For example, the antenna 100 shown in FIG. 7 includes a feeding probe 302'. The feeding probe 302' can be T-shaped. Also, the feeding probe 302' can be mounted to the conductive layer 102. In an aspect, the conductive layer 102 can be excited by the feeding probe 302'. The communication connector 304 can be mounted, for example, to the feeding probe 302' and/or the conductive layer 102.

Figure 8:
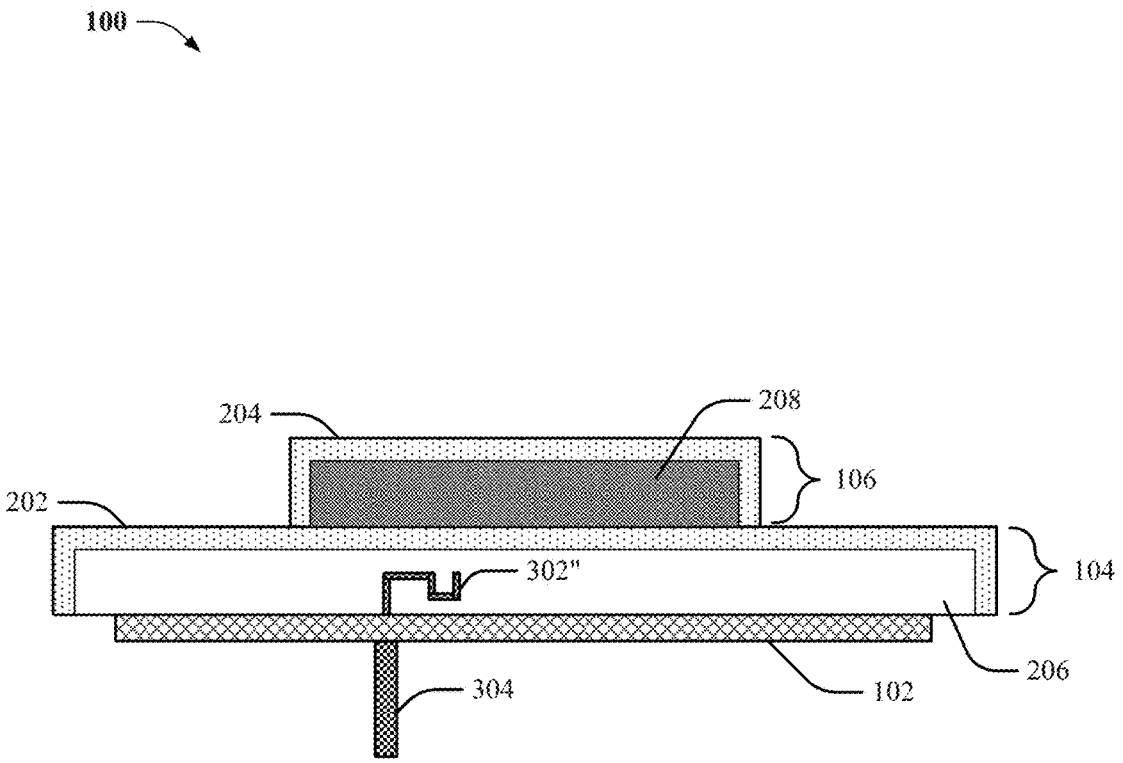
FIG. 8 illustrates a side view of the exemplary antenna that comprises yet another exemplary feeding probe, in accordance with various embodiments.

The antenna 100 shown in FIG. 8 includes a feeding probe 302". The feeding probe 302" can be meander-shaped (e.g., the feeding probe 302" can comprise a plurality of curves, the feeding probe 302" can comprise a plurality of arms oriented in different directions, etc.). The feeding probe 302" can be mounted to the conductive layer 102. In an aspect, the conductive layer 102 can be excited by the feeding probe 302". Furthermore, the communication connector 304 can be mounted to the feeding probe 302" and/or the conductive layer 102.

Figure 9:
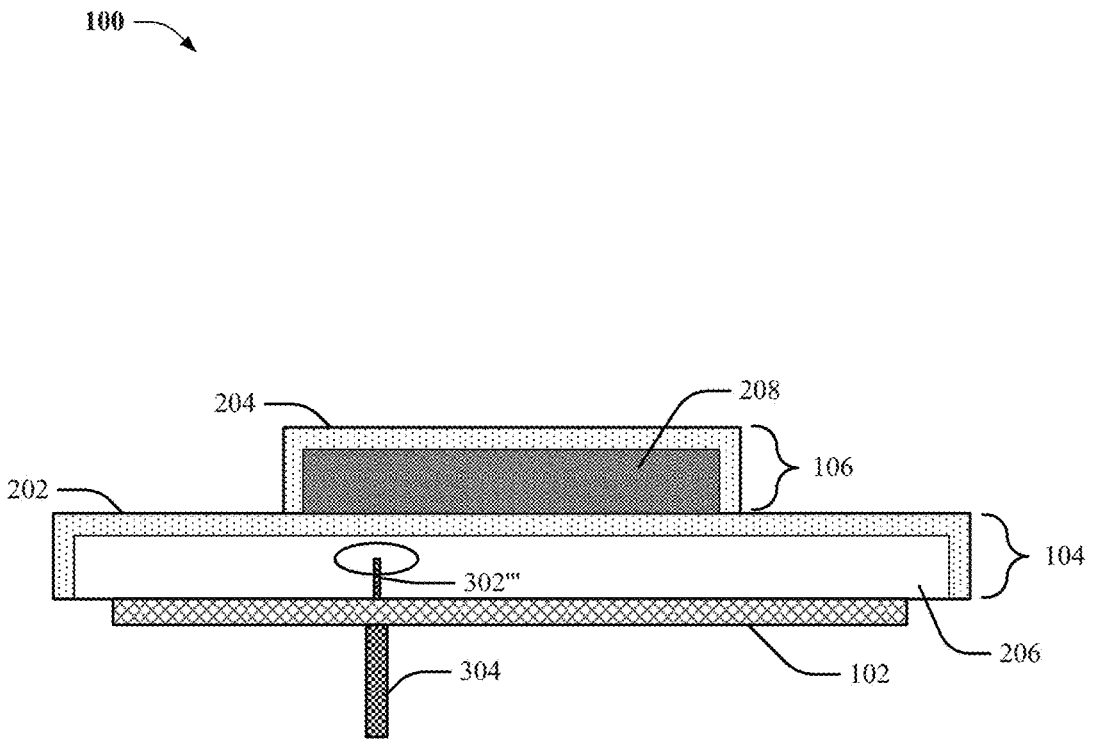
FIG. 9 illustrates a side view of the exemplary antenna that comprises yet another exemplary feeding probe, in accordance with various embodiments.

The antenna 100 shown in FIG. 9 includes a feeding probe 302'''. The feeding probe 302''' can be a probe with a top-loaded patch. For example, the feeding probe 302''' can be a probe associated with a disk-shaped portion. Also, the feeding probe 302''' can be mounted to the conductive layer 102. In an aspect, the conductive layer 102 can be excited by the feeding probe 302'''. The communication connector 304 can be mounted, for example, to the feeding probe 302''' and/or the conductive layer 102.

Figure 10:
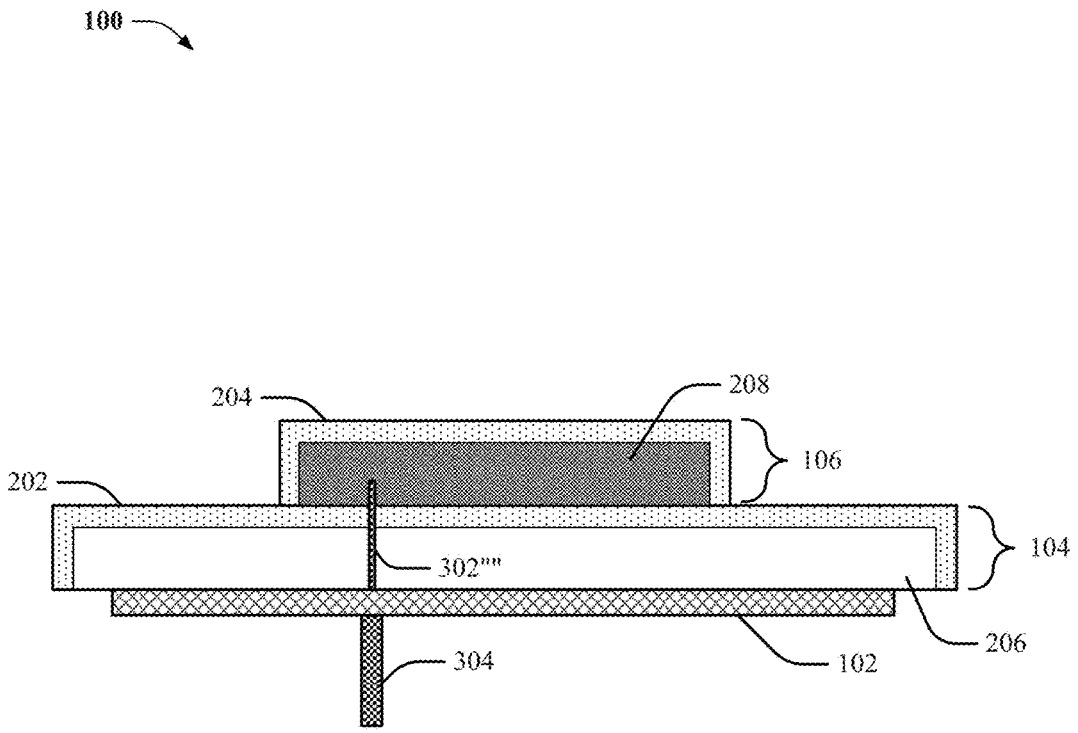
FIG. 10 illustrates a side view of the exemplary antenna that comprises yet another exemplary feeding probe, in accordance with various embodiments.

The antenna 100 shown in FIG. 10 includes a feeding probe 302''''. The feeding probe 302'''' can be a straight probe. The feeding probe 302'''' can be mounted to the conductive layer 102. Moreover, the feeding probe 302'''' can be inserted into the thermoplastic structure 204 (e.g., into the cavity 208 of the thermoplastic structure 204, into the fluid 402 of the thermoplastic structure 204, etc.). In an aspect, the conductive layer 102 can be excited by the feeding probe 302''''. Furthermore, the communication connector 304 can be mounted to the feeding probe 302'''' and/or the conductive layer 102.

Figure 11:
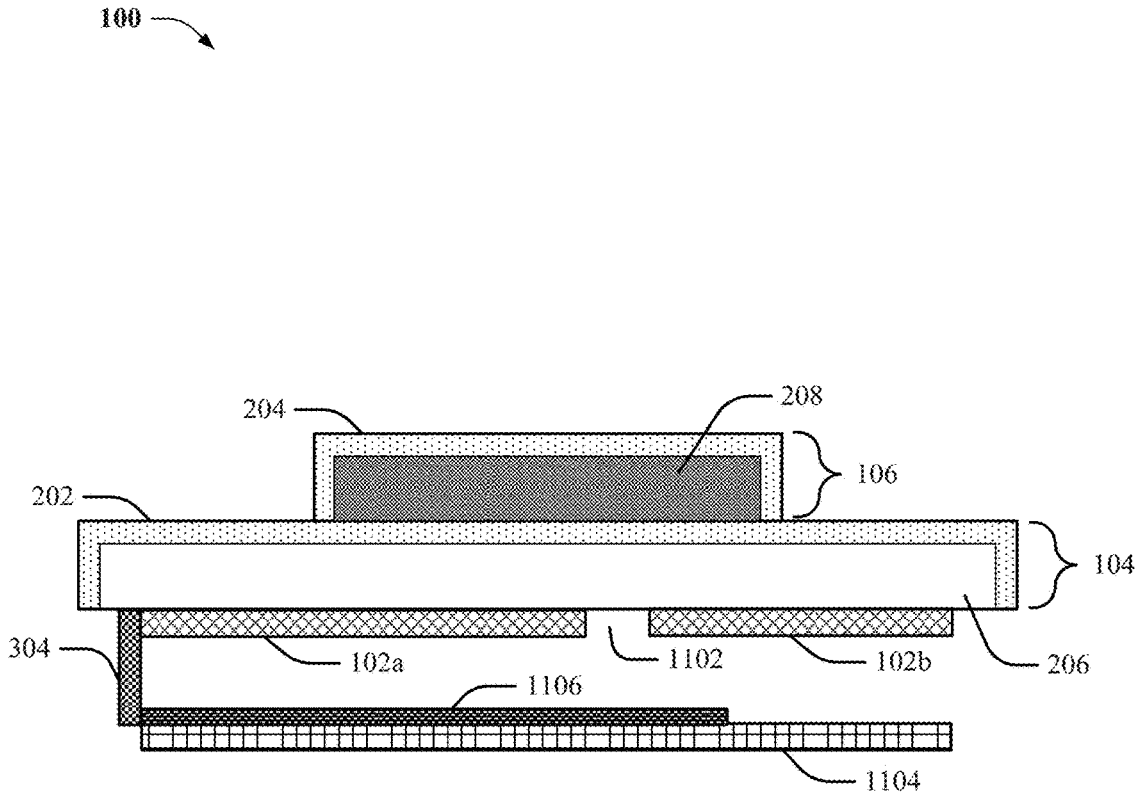
FIG. 11 illustrates an exemplary feeding technique for an antenna, in accordance with various embodiments.

Referring to FIG. 11, an alternate embodiment of the antenna 100 is illustrated, in accordance with various embodiments. As shown in FIG. 11, the conductive layer 102 comprises a first conductive layer 102*a* and a second conductive layer 102*b*. The conductive layer 102 comprises a coupling aperture 1102 (e.g. the coupling aperture 1102 can be cut into the conductive layer 102). For example, the coupling aperture 1102 can separate the first conductive layer 102*a* from the second conductive layer 102*b*. Furthermore, the conductive layer 102 can be excited by another substrate layer 1104 that comprises a microstrip transmission line 1106. The microstrip transmission line 1106 can be printed on the substrate layer 1104. In one example, the substrate layer 1104 can be a printed circuit board (PCB) substrate. The microstrip transmission line 1106 can be connected to the communication connector 304. Additionally or alternatively, the conductive layer 102 (e.g., the first conductive layer 102*a*) can be connected to the communication connector 304. The microstrip transmission line 1106 can be configured to excite the coupling aperture 1102.

Figure 12:
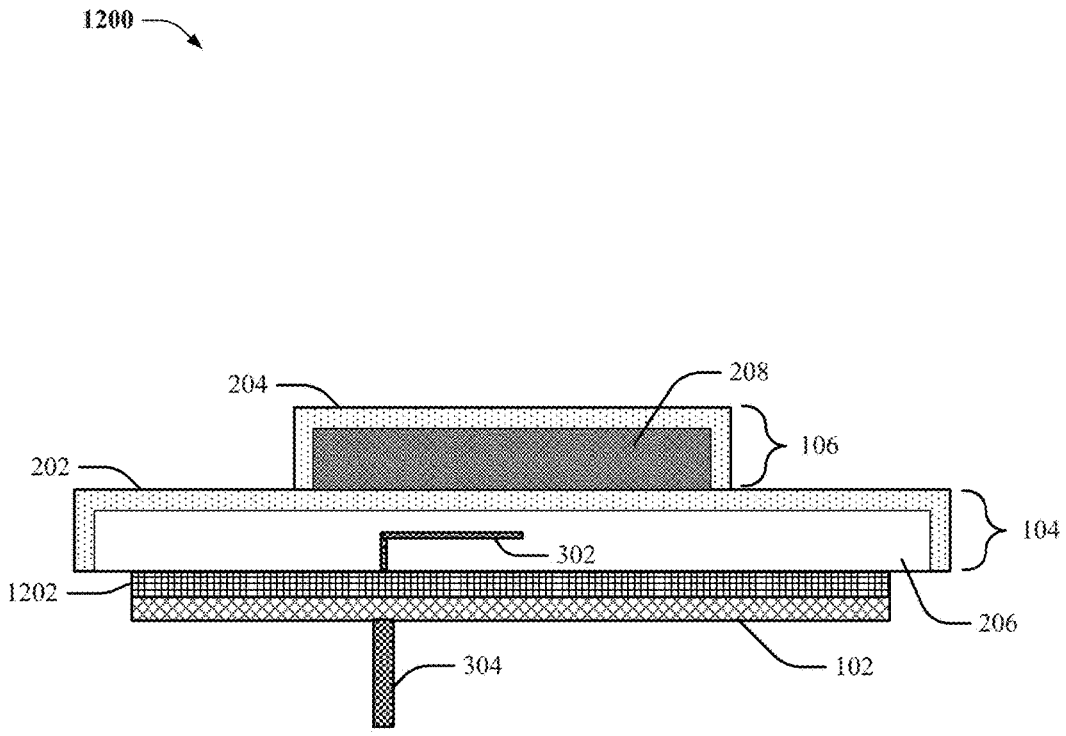
FIG. 12 illustrates a side view of an exemplary device that comprises an antenna and a set of solar cells, in accordance with various embodiments.

Referring now to FIG. 12, a device 1200 is illustrated, in accordance with various embodiments. The device 1200 includes the conductive layer 102, the substrate layer 104 (e.g., the thermoplastic structure 202 that comprises the cavity 206) and the dielectric layer 106 (e.g., the thermoplastic structure 204 that comprises the cavity 208). In certain implementations, the device 1200 can also include the feeding probe 302 and/or the communication connector 304. Alternatively, the device 1200 can include the feeding probe 302', the feeding probe 302", the feeding probe 302''' or the feeding probe 302''''. The device 1200 can also include a set of solar cells 1202. For example, the set of solar cells 1202 can be an array of solar cells. The set of solar cells 1202 can be attached to the conductive layer 102 and the substrate layer 104 (e.g., the set of solar cells 1202 can separate the conductive layer 102 and the substrate layer 104). The conductive layer 102, the substrate layer 104 and/or the dielectric layer 106 can be associated with the antenna 100. As such, the antenna 100 can be integrated with the set of solar cells 1202 to form the device 1200 (e.g., to form a dual-function device).

Figure 13:
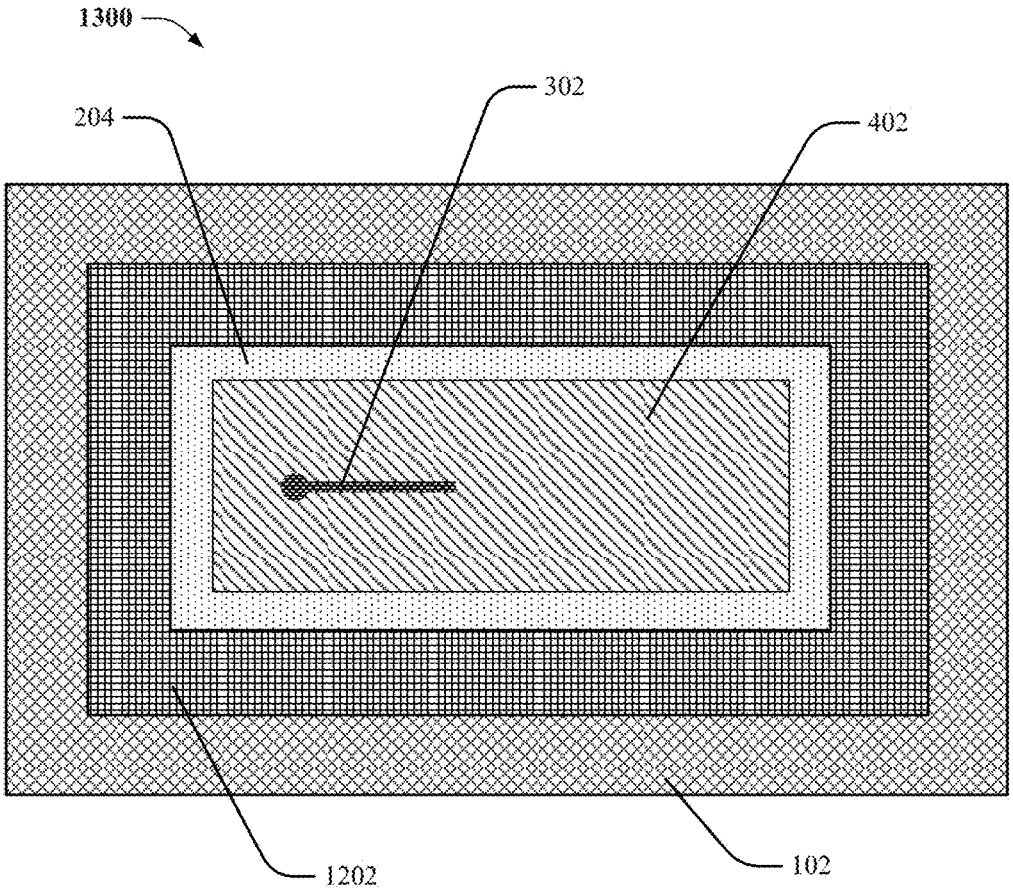
FIG. 13 illustrates a top view of the exemplary device, in accordance with various embodiments.

Referring to FIG. 13, a top view 1300 of the device 1200 is illustrated, in accordance with various embodiments. A cavity of the thermoplastic structure 204 can be filled with the fluid 402. Furthermore, the feeding probe 302 can be aligned underneath the thermoplastic structure 204 (e.g., underneath the fluid 402 filled in the cavity of the thermoplastic structure 204). The set of solar cells 1202 can also be aligned underneath the thermoplastic structure 204, and the conductive layer 102 can be aligned underneath the set of solar cells 1202. In an aspect, a surface area associated with the set of solar cells 1202 can be larger than a surface area of the thermoplastic structure 204. Furthermore, a surface area of the conductive layer 102 can be larger than the surface area associated with the set of solar cells 1202.

Figure 14:
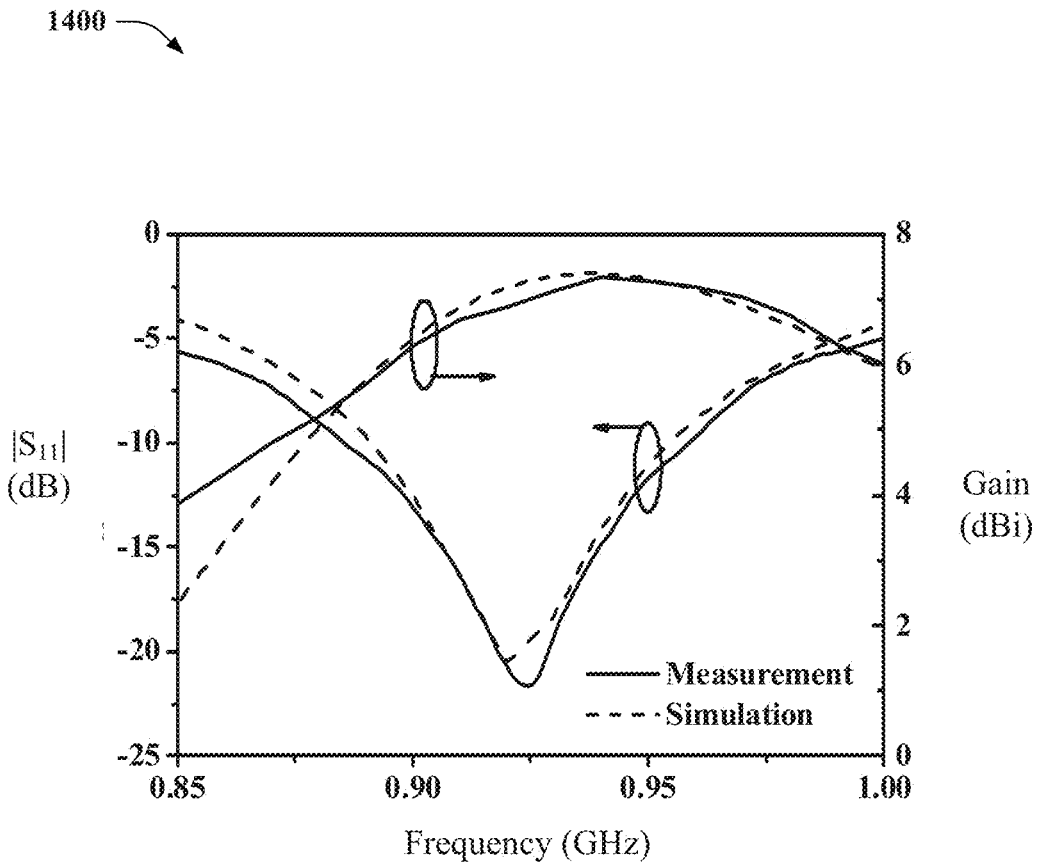
FIG. 14 illustrates a measured and a simulated reflection coefficient |S11| and gain of a patch antenna, in accordance with various embodiments.

FIG. 14 illustrates a measured reflection coefficient |S11|, a simulated reflection coefficient |S11|, a measured gain and simulated gain of a patch antenna (e.g., the antenna 100), as more fully disclosed herein. A reflection coefficient |S11| can represent an amount of power reflected by the patch antenna. A gain can represent an ability of the patch antenna to direct energy in a particular pattern. Simulated bandwidth of the patch antenna is 7.05% (e.g., from 0.89 to 0.95 GHz) and measured bandwidth of the patch antenna is 8.02% (e.g., from 0.88 to 0.96 GHz), with reflection coefficient $|S11| < -10$ dB. As shown in FIG. 14, simulated gain of the patch antenna reaches 7.4 dBi and measured gain of the patch antenna reaches 7.34 dBi. Furthermore, 3-dB gain bandwidth by simulation is 17.0% and 3-dB gain bandwidth by measurement is 18.5%, which are wider than an impedance bandwidth of the patch antenna.

Figure 15:
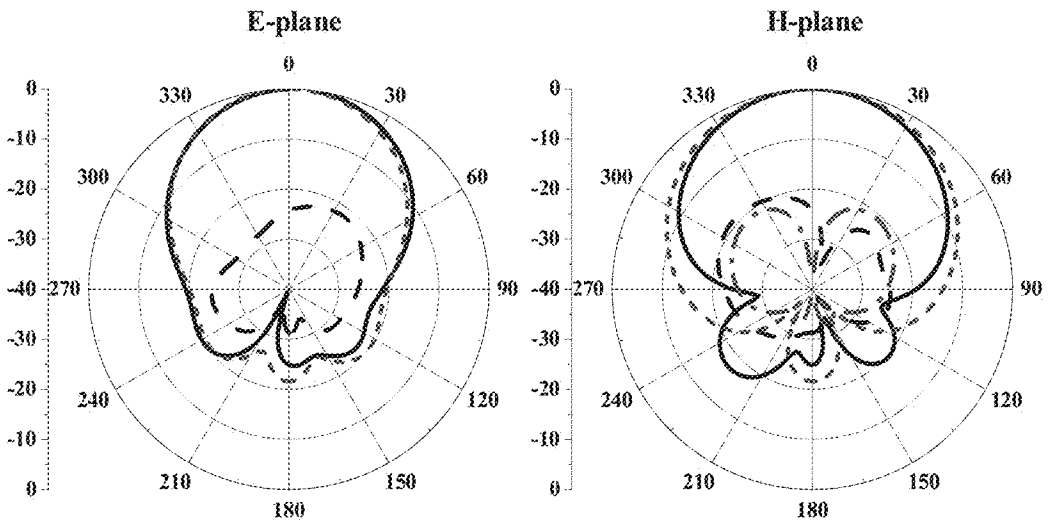
FIG. 15 illustrates a measured radiation pattern and a simulated radiation pattern of a patch antenna, in accordance with various embodiments.

FIG. 15 illustrates a measured radiation pattern and a simulated radiation pattern of a patch antenna (e.g., the antenna 100), as more fully disclosed herein. For example, a simulated radiation pattern and a measured radiation pattern at a center frequency of an operating band for a patch antenna (e.g., the antenna 100) are shown in FIG. 15. As shown in FIG. 15, a symmetrical radiation pattern and unidirectional radiation pattern are obtained in both E-plane and H-plane. As further shown in FIG. 15, a measured backlobe and a measured cross polarization level are both lower than −20 dB. Accordingly, an operation mechanism of the patch antenna can be different than conventional antennas (e.g., conventional water monopole antennas, conventional water dielectric resonator antennas, etc.). Moreover, the patch antenna (e.g., the antenna 100) disclosed herein can comprise a lower profile, improved radiation characteristics (e.g., higher radiation efficiency), a wider impedance bandwidth (e.g., a wide operating bandwidth greater than 20%), and/or improved transparency as compared to conventional antennas.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A patch antenna, comprising:

a substrate layer that comprises a first thermoplastic structure that comprises a first cavity filled with air, wherein the first cavity contains a feeding probe for the patch antenna;

a dielectric layer that is attached to a first surface of the substrate layer and comprises a second thermoplastic structure that comprises a second cavity filled with a nonmetal fluid; and a conductive layer that is attached to a second surface of the substrate layer and the feeding probe contained within the first cavity filled with the air.

2. The patch antenna of claim 1, wherein the second thermoplastic structure that comprises the second cavity filled with the nonmetal fluid is smaller than the first thermoplastic structure that comprises the first cavity filled with the air.

3. The patch antenna of claim 1, wherein the conductive layer is electrically coupled to the feeding probe.

4. The patch antenna of claim 1, wherein a communication connector is mounted to the feeding probe.

5. The patch antenna of claim 1, wherein the feeding probe is L-shaped.

6. The patch antenna of claim 1, wherein the feeding probe is T-shaped.

7. The patch antenna of claim 1, wherein the conductive layer comprises a coupling aperture.

8. The patch antenna of claim 1, wherein the substrate layer is a first substrate layer, and wherein the conductive layer is electrically coupled to a second substrate layer that comprises a microstrip transmission line.

9. The patch antenna of claim 1, wherein the conductive layer is electrically coupled to the feeding probe, and wherein the feeding probe is inserted into the dielectric layer.

10. The patch antenna of claim 1, wherein the substrate layer is square-shaped and the dielectric layer is a different shape.

11. The patch antenna of claim 1, wherein the nonmetal fluid comprises water, methanol, alcohol or glycerin.

12. The patch antenna of claim 1, wherein the first thermoplastic structure and the second thermoplastic structure are transparent.

13. The patch antenna of claim 1, wherein the substrate layer and the conductive layer are mounted to a set of solar cells.

14. A device, comprising:

an antenna that comprises a fluid layer, a metallic layer attached to a feeding probe, and a substrate layer between the fluid layer and the metallic layer, wherein the substrate layer comprises a first thermoplastic structure that comprises a first cavity filled with air, wherein the first cavity contains a feeding probe for the antenna, wherein the fluid layer comprises a second thermoplastic structure that comprises a second cavity filled with a nonmetal fluid, and wherein the metallic layer is attached to the feeding probe; and a set of solar cells attached to the metallic layer and the substrate layer.

15. The device of claim 14, wherein the substrate layer comprises a larger surface area than the fluid layer.

16. The device of claim 14, wherein the first thermoplastic structure and the second thermoplastic structure are transparent thermoplastic structures.

17. The device of claim 14, wherein the fluid layer comprises a different shape than the substrate layer.

18. An antenna system, comprising:

a first thermoplastic structure that comprises a first cavity filled with a nonmetal fluid;

a second thermoplastic structure that comprises a second cavity filled with air and supports the first thermoplastic structure via a first surface, wherein the second cavity contains a feeding probe for the antenna system; and a conductive ground plane attached to the feeding probe and a second surface of the second thermoplastic structure.

19. The antenna system of claim 18, wherein a portion of the first surface is attached to the first thermoplastic structure.

20. The antenna system of claim 18, wherein the feeding probe is electrically coupled to the conductive ground plane.

* * * * *